United States Patent [19]

Hata

[11] Patent Number: 4,913,367

[45] Date of Patent: Apr. 3, 1990

[54] COIL WIDTH DETECTING APPARATUS FOR COIL MATERIAL FEEDING UNIT

[75] Inventor: Yukio Hata, Ishikawa, Japan

[73] Assignee: Kabushiki Kaisha Komatsu Seisakusho, Tokyo, Japan

[21] Appl. No.: 360,934

[22] PCT Filed: Jul. 13, 1988

[86] PCT No.: PCT/JP88/00696

§ 371 Date: Mar. 9, 1989

§ 102(e) Date: Mar. 9, 1989

[87] PCT Pub. No.: WO89/00466

PCT Pub. Date: Jan. 26, 1989

[30] Foreign Application Priority Data

Jul. 14, 1987 [JP] Japan ..... 62-173854

[51] Int. Cl.[4] ..... B65H 67/00; B65H 19/12; B21C 47/16

[52] U.S. Cl. ..... 242/57; 242/68.4; 242/78.6; 242/78.1

[58] Field of Search ..... 242/55, 55.01, 55.1, 242/57, 58, 68.1, 68.2, 68.4, 71.9, 73, 129.51, 129.7, 184, 186, 78, 78.1, 78.6, 78.8, 79, 81, 82; 235/151.32, 150.3, 151.1; 73/490, 491; 33/141 B, 142, 452, 454, 712, 733, 753, 783, 792, 793, 806, 503

[56] References Cited

U.S. PATENT DOCUMENTS

| | | | |
|---|---|---|---|
| 853,262 | 5/1907 | Putnam | 33/733 |
| 2,800,288 | 7/1957 | Bandy | 242/68.4 |
| 2,967,675 | 1/1961 | Markey | 242/78.6 |
| 3,058,448 | 10/1962 | Wagner | 242/78.6 X |
| 3,197,876 | 8/1965 | Smith | 33/556 |
| 3,216,672 | 11/1965 | Littell | 242/78.6 |
| 3,424,394 | 1/1969 | Moore | 242/79 X |
| 3,695,542 | 10/1972 | Briggs | 242/68.4 X |
| 4,218,002 | 8/1980 | Whalen | 242/57 X |
| 4,718,817 | 1/1988 | Maillefer | 242/79 X |
| 4,757,953 | 7/1988 | Maier et al. | 242/57 X |

FOREIGN PATENT DOCUMENTS

| | | |
|---|---|---|
| 42-20185 | 10/1967 | Japan . |
| 51-50262 | 5/1976 | Japan . |
| 57-68231 | 4/1982 | Japan . |
| 58-44916 | 3/1983 | Japan . |

*Primary Examiner*—Donald Watkins

*Attorney, Agent, or Firm*—Diller, Ramik & Wight

[57] ABSTRACT

The present invention is concerned with a technique for measuring the width (l) of a strip uncoiled from a coil material (3) to be fed to a press line, wherein linear displacement of both support shafts (4) on uncoiler mechanisms (1) adapted to support the coil material (3) from both sides using a mechanism including racks (8) and a pinion (5) is converted into rotational displacement so that an amount of actual linear displacement of both the support shafts (4) represented by $(L_1+L_2)$ is detected by detecting the rotational displacement of the pinion 5. The coil width is measured by subtracting the amount of linear displacement of the pinions (5) represented by $(L_1+L_2)$ from the distance (L) between both of support shafts which can be measured when both the support shafts (4) are displaced to predetermined positions where they are displaced to the rearmost ends. This enables incorrect setting of the coil material to be checked by comparing the measured coil width (l) with the coil width data (lc) which have been previously inputted.

9 Claims, 3 Drawing Sheets

COIL WIDTH DETECTING APPARATUS FOR COIL MATERIAL FEEDING UNIT

TECHNICAL FIELD

The present invention relates to a coil width detecting apparatus usable for a coil material feeding unit adapted to continuously feed the strip uncoiled from a coil material loaded on uncoilers wherein a width of the coil material is checked by measurement.

BACKGROUND ART

A coil material feeding unit adapted to feed to a press line the strip uncoiled from a coil material is provided with uncoilers for continuously uncoil the coil material which has been transferred to the uncoilers. The strip uncoiled from the coil material by the uncoilers is caused through a leveller to straighten the curved contour of the strip as seen immediately after the uncoiling therefrom and thereafter it is fed to the press line where it receives forming operation.

A coil material to be loaded on the uncoilers has a width different from production lot to production lot and this fact requires an operator to input into a control section of the coil material feeding unit the width of a coil material to be loaded on the uncoilers before the coil material is loaded on the uncoilers. The control section is adapted to perform control operations in correspondence to a width of the coil material on the basis of data which have been inputted thereinto.

In fact, a conventional coil material feeding unit does not measure the width of a coil material conveyed to uncoilers and moreover it does not check whether or not it coincides with the coil width data which have been inputted into the control section. This leads to such a malfunction that the inputted coil width data do not often coincide with the actual width of a coil material which has been transferred to the uncoilers, resulting in correct control operations failing to be performed.

The present invention has been made with the foregoing background in mind and its object resides in providing a coil width detecting apparatus usable for a coil material feeding unit which assures that the width of a coil material can be measured exactly and an occurrence of incorrect setting of a coil material can be prevented reliably.

DISCLOSURE OF THE INVENTION

To accomplish the above object, the present invention provides a coil width detecting apparatus usable for a coil material feeding unit wherein the apparatus comprises a coil material having a hole formed at the central part thereof, an uncoiler mechanism including a pair of cylinder mechanisms adapted to move in the axial direction of the coil material so as to allow the coil material to be clamped from both sides by inserting into the hole of the coil material a pair of support shafts secured to the foremost ends of piston rods in the cylinder mechanisms, a pair of racks secured to the support shafts to move in the same direction as that of movement of the support shafts in compliance with the movement of the latter, a pinion interposed between the pair of racks to mesh with the latter, rotational displacement detecting means for detecting the rotational displacement of the pinion during a period of movement of the support shafts from a predetermined position where they are displaced to the rearmost ends to a predetermined position where the coil material is held in a clamped state, setting means for previously setting a distance between both the support shafts when the latter are located at the position where they are displaced to the rearmost ends, and subtracting means for subtracting the value detected by the rotational displacement detecting means from the value set by the setting means to output a result derived from the subtraction as an actual coil width.

With such construction, a value detected by the rotational displacement detecting means represents a value corresponding to a sum of distances of actual displacement of the respective support shafts when the latter have been displaced from the rearmost ends to the clamp positions. Thus, an actual coil width can be obtained by subtracting the value detected by the rotational displacement detecting means from the distance between both the support shafts which can be measured when they are located at the rearmost ends. Incidentally, with the mechanism including racks and a pinion as mentioned above, rotational displacement of the pinion represent a sum of distances of actual displacement of both the support shafts. Thus, centering of the coil material is not required any longer.

In addition to the above construction, the apparatus of the present invention further includes coil width data setting means for setting coil with data which have been inputted by an operator, comparing means for comparing a value set by the coil width data setting means with an output from the subtracting means, displaying means for displaying on the basis of a result derived from the comparison made by the comparing means that the value set by the coil width data setting means does not coincide with the value of output from the subtracting means and means for setting the coil width data as a normal value when it is found as a result derived from the comparison made by the comparing means that the value set by the second setting means coincides with the value of output from the subtracting means.

Consequently, with such construction, a value derived from measurement made for the coil with is compared with the coil width data which have been previously inputted and if it is found that the former does not coincides with the latter, this fact is displayed. Only when it is found that the former coincides with the latter, the coil width data are put in use.

As will be apparent from the above description, the apparatus of the present invention assures that the width of a coil material can be simply measured without any necessity for centering the coil material. Additionally, since data derived from measurements are compared with the coil width data which have been previously inputted, incorrect setting of the coil material can be directed prior to starting a step of forming, even when the coil material which has been transferred to the coil material feeding unit has a width different from the inputted data. This assures that an occurrence of various malfunctions due to incorrect setting of the coil material can be prevented reliably.

BEST MODE FOR CARRYING OUT THE INVENTION

Now, the present invention will be described in a greater detail hereinafter with reference to the accompanying drawings which illustrate a preferred embodiment thereof.

Figure 1:
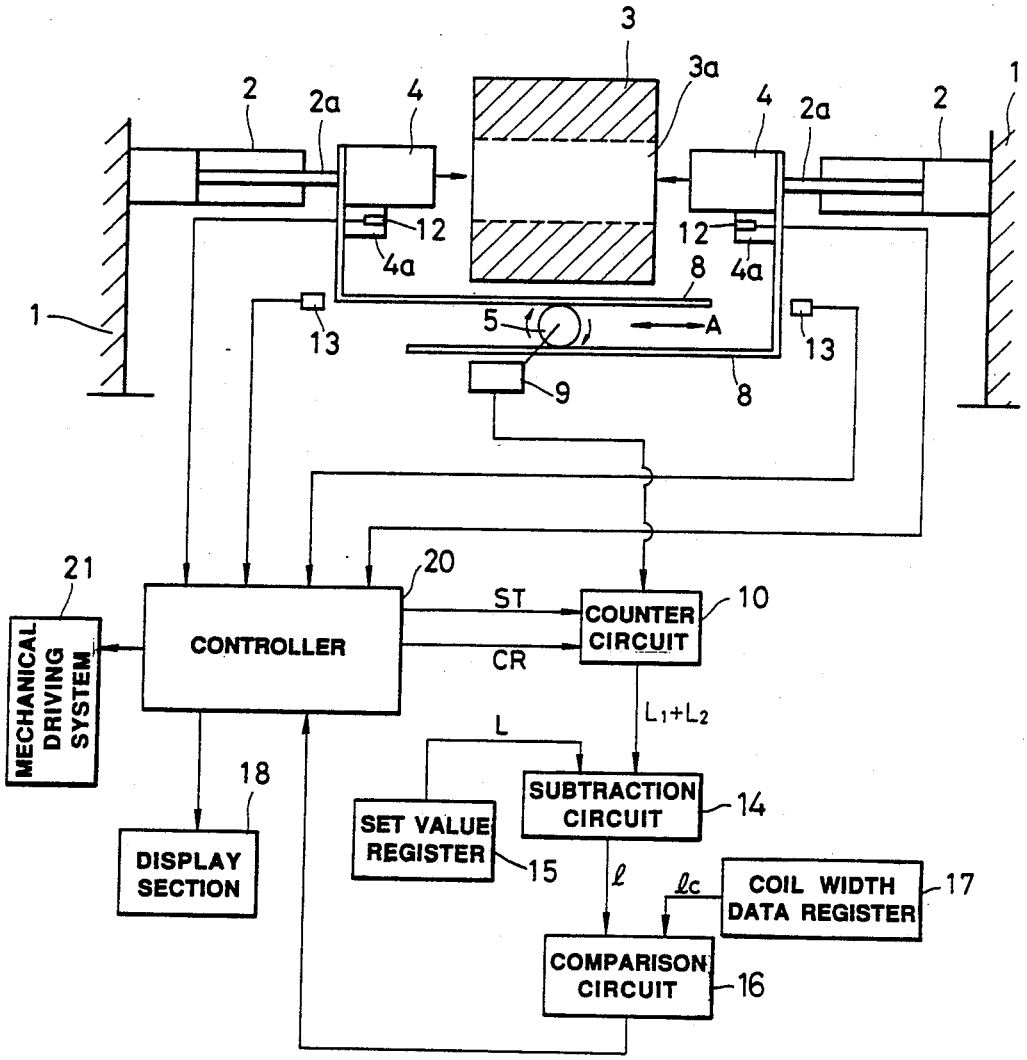
FIG. 1 is a schematic block diagram illustrating the structure of an apparatus in accordance with an embodiment of the present invention.

In FIG. 1, reference numeral 1 designates an uncoiler which is provided for a coil material feeding unit. As will be apparent from the drawing, an opposite pair of cylinders 2 are secured to the uncoilers 1 and a piston rod 2a in each of the cylinders 2 has a support shaft 4 connected to the foremost end thereof so as to allow a coil material 3 to be clamped between the support shafts 4. Specifically, the coil material 3 in the form of a roll is formed with a center hole 3a at the central part thereof so that the coil material 3 is clamped between both the support shafts 4 which have been inserted into the center hole 3a from both sides. The support shaft 4 has a stopper 4a attached thereto so that a distance of the inserting of the support shaft 4 into the center hole 3a of the coil material 3 is limited by the stopper 4a.

Figure 2:
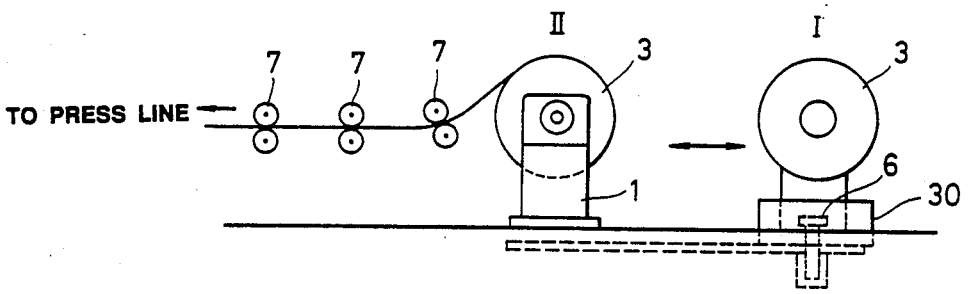
FIG. 2 is a schematic view illustrating how a coil material is transferred to uncoilers.
Figure 3:
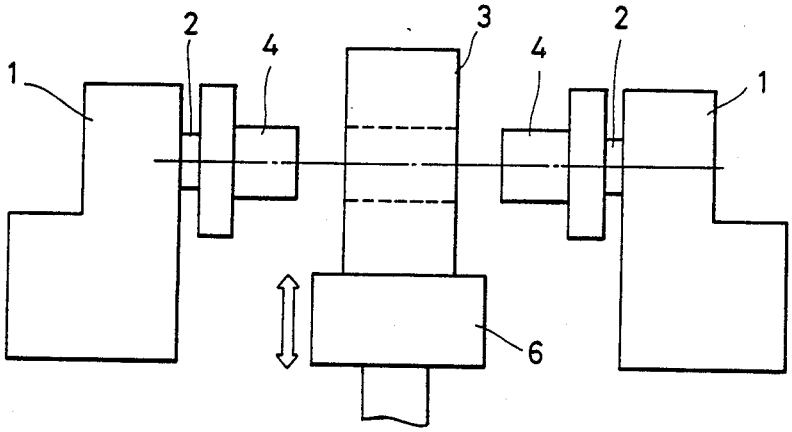
FIG. 3 is a schematic view illustrating how the coil material is loaded on the uncoilers from a coil car.

The coil material 3 is conveyed to a space as defined between the cylinders 2 using a coil car 30. As is best seen in FIG. 2, the coil car 30 is movable from a waiting position I to an unloading position II where a coil material 3 is unloaded and vice versa. In addition, the coil car 30 is equipped with a lifter 6 for lifting the coil material 3 up to an uncoiling position. When the coil material 3 is to be loaded between the uncoilers 1, the coil car 30 starts its movement at the waiting position I and then it stops at the unloading position II located just beneath the center line of the support shafts 4. Then, the lifter 6 on the coil car 30 lifts the coil material 3 in response to a value of outer diameter of the coil material 3 which has been detected by a detector which is not shown in the drawings and lifting movement of the coil material 3 is stopped when the center lines of the support shafts 4 are located in alignment with the axis of the coil material 3. Thereafter, the respective cylinders 2 start forward movement of their pistons toward the central part of the coil material 3 so as to permit the coil material 3 to be clamped between the support shafts 4. Then, the lifter 6 stops lifting movement so that the coil car 30 returns to the waiting position I. As shown in FIG. 2, a strip wound round the coil material 3 is fed to a press line while it is transferred by plural sets of feed rollers 7.

The coil material feeding unit is constructed in the following manner to measure and check an actual width of the coil material 3. In fact, this construction constitutes an essential part of the present invention.

Figure 4:
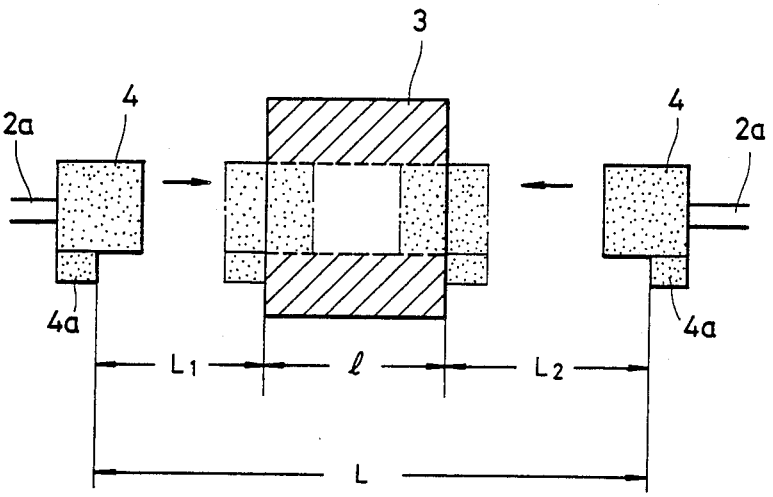
FIG. 4 is a schematic view illustrating a principle of detecting the width of a coil material using the apparatus of the present invention.

Specifically, as shown in FIG. 1, each of the support shafts 4 for the uncoilers 1 has a L-shaped rack 8 secured thereto which is formed with a number of teeth over a joint region where the rack 8 is adapted to mesh with a pinion 5. As is apparent from the drawing, the pinion 5 meshes with a pair of racks 8 which extend in parallel to each other while it is interposed therebetween. With this construction using the pinion 5 and the racks 8, the pinion 5 is rotated by an angle (representative of an angular displacement) corresponding to a sum of distances of movements of both the support shafts 4. As shown in FIG. 4, it is assumed that a distance between the support shafts 4 in an inoperative state where the piston rods 2a of the respective cylinders 2 are retracted to their inoperative position, i.e., a distance between the stoppers 4a of the support shafts 4 is identified by L (fixed value) and a distances by which the the support shafts 4 move from their initial position to an operative position where the coil material 3 is clamped therebetween are identified by $L_1$ and $L_2$ ($L_1<L_2$). In this case, it should be noted that the coil material 3 is not located between an exactly intermediate position between both the support shafts 4.

In such a case, both the support shafts 4 move in the forward direction during a period of movement by the first distance $L_1$ and then only the right-hand support shaft 4 as viewed in FIG. 1 moves further until the stopper 4a of both the support shafts 4 abut against the coil material 3 to assume the clamped state. When both the support shafts 4 move by the first distance, this causes two racks 8 to move in the direction opposite to each other whereby the pinion 5 is rotated at a fixed position. Thereafter, when only one support shaft 4, i.e., the right-hand support shaft 4 moves further, this causes only one rack 8, i.e., the right-hand rack 8 to move further but the other rack 8 is kept immovable. At this time, the pinion 5 is rotated while it moves in the same direction as that of movement of the right-hand rack 8. When a comparison is made between an amount of rotational displacement (indicative of rotational angle) of the pinion 5 during the first-mentioned state and the same during the last-mentioned state, the result is that an amount of rotational angle of the pinion 5 during movement of both the racks 8 is two times as much as an amount of rotational angle of the pinion 5 during movement of only one rack 8.

With such construction including the pinion 5 and the racks 8, in the case as shown in FIG. 4, an amount of rotational displacement of the pinion 5 during a period of the first movement of both the support shafts 4 by a distance of $L_1$ corresponds to movement of the support shaft 4 by a distance of $2L_1$, whereas an amount of rotational displacement of the pinion 5 during a period of the later movement of only the right-hand support shaft 4 corresponds to movement of the support shaft 4 by a distance of $(L_1-L_2)$. Consequently, a final amount of rotational displacement of the pinion 5 corresponds to movement of the support shaft 4 by a distance represented by $2L_1+(L_1-L_2)=L_1+L_2$.

Thus, an actual width l of the coil material 3 can be represented in accordance with the following formula (1).

$$l=L-(L_1+L_2) \quad (1)$$

Accordingly, the actual width l of the coil material 3 can be derived from subtraction of a distance of movement of both the support shafts 4 represented by $(L_1+L_2)$ from the foregoing distance of L (fixed value) which has been previously measured.

Next, description will be made below as to construction required for calculation in accordance with the above formula (1). Referring to FIG. 1, a rotary encoder 9 is adapted to generate the number of pulses corresponding to an amount of rotational displacement of the pinion 5 and the generated pulses are inputted into a counter circuit 10. Each of the stoppers 4a of the support shafts 4 is provided with a touch sensor 12 so that outputs from the touch sensors 12 are inputted into a controller 20. Since limit switches 13 are actuated by the respective racks 8 when the respective support shafts 4 move back to their rearmost ends, outputs from the limit switches 13 indicative of the detection of backward movement of the racks 8 are also inputted into the controller 20.

When both the limit switches 13 are turned on in response to the foregoing backward movement of the racks 8, the controller 20 outputs a clear signal CR to clear the value counted in the counter circuit 10. At this moment, a driving section 21 for driving a mechanism including the cylinders 2 and associated components is brought in an operable state. In addition, when boththe touch sensors 20 are turned on in response to abutment of the support shafts 4 against the coil material 3, the controller 20 outputs a stop signal ST to stop the counting operation in the counter circuit 10. Consequently, a value of calculation corresponding to a distance (representative of $L_1+L_2$ in FIG. 4) required for movement of both the support shafts 4 from a predetermined rearmost end to a predetermined foremost end is outputted from the counter circuit 10. The value calculated in the counter circuit 10 is inputted into a subtraction circuit 14 in the form of a subtraction numeral. The distance L indicative of the positions where both the support shafts 4 are located at the rearmost ends has previously stored in a set value register 15 and this allows the value L stored in the set value register 15 to be inputted into the subtraction circuit 14 in the form a numeral to be subtracted.

The subtraction circuit 14 is activated to calculate the actual width l of the coil material 3 by performing the calculation in accordance with the formula (1), i.e., the calculation for $L-(L_1+L_2)$ and then input the calculated value l into a comparison circuit 16. A coil width lc set by an operator has been previously stored in a coil width data register 17 and this allows the coil width data lc to be inputted into the comparison circuit 16.

The comparison circuit 16 compares the inputted value of coil width with the inputted value lc of coil width so that a result derived from the comparison is inputted into the controller 20. When it is found as a result of the comparison that the value l of coil width coincides with the value c of coil width, the controller 20 is activated to set the coil width data as an adequate value which will be used later for the purpose of performing a variety of calculations under a proper control. If it is found that the former coil width does not coincides with the latter coil width, this is displayed on a display section 18 to inform the operator of an occurrence of incorrect setting of the coil material 3.

As described above, since the apparatus in accordance with the illustrated embodiment is so constructed that actual displacement of both the support shafts 4 is converted into rotational displacement via a mechanism including the pinion 5 and the racks 8 and the rotational displacement is then measured using the rotary encorder 9, the counter 10 and so forth, it is assured that the coil width can be simply measured at a high accuracy without any necessity for exactly centering the coil material 3. Further, with the apparatus of the present invention, prior to starting the feeding of a coil material, the actually measured data l are checked by comparing them with the coil width data lc which have been set by an operator. Thus, when the former do not coincide with the latter, this fact is displayed, and when the former coincide with the latter, only the coil width data lc are used later. Accordingly, it is assured that an occurrence of various kinds of malfunctions caused by incorrect setting of the coil material can be prevented reliably.

INDUSTRIAL APPLICABILITY

The present invention can be applied to a coil material feeding unit including uncoilers adapted to feed to a press line the strip uncoiled from a coil material.

I claim:

1. A coil width detecting apparatus usable for a coil material feeding unit comprising;
   - a coil material having a hole formed at the central part thereof,
   - an uncoiler mechanism including a pair of cylinder mechanisms adapted to move in the axial direction of said coil material so as to allow the coil material to be clamped from both sides by inserting into said hole of the coil material a pair of support shafts secured to the foremost ends of piston rods in said cylinder mechanisms,
   - a pair of racks secured to said support shafts to move in the same direction as that of movement of the support shafts in compliance with the movement of the latter,
   - a pinion interposed between said pair of racks to mesh with the latter,
   - rotational displacement detecting means for detecting the rotational displacement of said pinion during a period of movement of the support shafts from a predetermined position where they are displaced to the rearmost ends to a predetermined position where the coil material is held in a clamped state,
   - setting means for previously setting a distance between both the support shafts when the latter are located at the position where they are displaced to the rearmost ends, and
   - subtracting means for subtracting the value detected b said rotational displacement detecting means from the value set by said setting means to output a result derived from the subtraction as an actual coil width.

2. A coil width detecting apparatus usable for a coil material feeding unit as claimed in claim 1, wherein each of the pair of support shafts is provided with a stopper portion adapted to abut against the coil material.

3. A coil width detecting apparatus usable for a coil material feeding unit as claimed in claim 1, wherein said rotational displacement detecting means comprises;
   - first detecting means for detecting that the respective support shafts are located at the predetermined rearmost ends,
   - second detecting means for detecting that the respective support shafts are located at predetermined clamp positions, and
   - third detecting means for detecting the rotational displacement of the pinion on the basis of outputs from said first detecting means and said second detecting means during a period of time from the starting of movement of the support shafts from the predetermined rearmost ends to the outputting of a detected signal from said second detecting means.

4. A coil width detecting apparatus usable for a coil material feeding unit as claimed in claim 3, wherein said third detecting means comprises;
   - pulse generating means for generating the number of pulses corresponding to the rotational displacement of the pinion, and
   - a counter for counting said pulses generated by said pulse generating means.

5. A coil width detecting apparatus usable for a coil material feeding unit as claimed in claim 4, wherein said pulse generating means comprises a rotary encoder.

6. A coil width detecting apparatus usable for a coil material feeding unit as claimed in claim 4, wherein said counter is cleared in response to an output from said first detecting means and stops the counting operation in response to an output from said second detecting means.

7. A coil width detecting apparatus usable for a coil material feeding unit as claimed in claim 3, wherein each of the support shafts is provided with a stopper portion adapted to abut against the coil material and said second detecting means comprises a touch sensor which is disposed on the coil material abutment surface of said stopper portion.

8. A coil width detecting apparatus usable for a coil material feeding unit as claimed in claim 3, wherein said first detecting means comprises a limit switch.

9. A coil width detecting apparatus usable for a coil material feeding unit comprising;

a coil material having a hole formed at the central part thereof, an uncoiler mechanism including a pair of cylinder mechanisms adapted to move in the axial direction of said coil material so as to allow the coil material to be clamped from both sides by inserting into said hole of the coil material a pair of support shafts secured to the foremost ends of piston rods in said cylinder mechanisms, a pair of racks secured to said movement of the support shafts in compliance with the movement of the latter, a pinion interposed between said pair of racks to mesh with the latter, rotational displacement detecting means for detecting the rotational displacement of said pinion during a period of movement of the support shafts from a predetermined position where they are displaced from the rearmost ends to a predetermined position where the coil material is held in a clamped state, setting means for previously setting a distance between both the support shafts when the latter are located at the rearmost ends, subtracting means for subtracting the value detected by said rotational displacement detecting means from the value set by said setting means to output a result derived from the subtraction as an actual coil width, second setting means for setting the coil width data which have been inputted by an operator, comparing means for comparing the value set by said second setting means with the output from said subtracting means, displaying means for displaying on the basis of a result derived from the comparison made by said comparing means that the value set by the second setting means does not coincide with the value of an output from the subtracting means, and means for setting the coil width data as a normal value when it is found as a result derived from the comparison made by the comparing means that the value set by the second setting means coincides with the value of on output from the subtracting means.

* * * * *